US007350669B2

(12) United States Patent
Rani

(10) Patent No.: US 7,350,669 B2
(45) **Date of Patent: *Apr. 1, 2008**

(54) CLOSURE DEVICE FOR FLEXIBLE POUCHES

(75) Inventor: Robert G. Rani, Vadnais Heights, MN (US)

(73) Assignee: Novartis AG, Basel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/672,318

(22) Filed: Sep. 26, 2003

(65) Prior Publication Data

US 2004/0094571 A1 May 20, 2004

Related U.S. Application Data

(60) Provisional application No. 60/417,917, filed on Oct. 11, 2002.

(51) Int. Cl.
*B65D 35/00* (2006.01)

(52) U.S. Cl. ..... 222/92; 222/107; 222/153.06; 222/566; 604/905; 215/249

(58) Field of Classification Search ..... 222/92, 222/568, 153.02, 107, 153.06, 153.07, 541.1, 222/566, 541.2, 567, 541.5, 541.6, 541.4; 604/415, 905, 411–412, 403; 215/247, 249
See application file for complete search history.

(56) References Cited

U.S. PATENT DOCUMENTS

| | | | | |
|---|---|---|---|---|
| 3,071,274 | A * | 1/1963 | Jacob | 215/249 |
| 3,364,930 | A * | 1/1968 | Ryan | 604/244 |
| 4,187,893 | A * | 2/1980 | Bujan | 604/408 |
| 4,479,989 | A | 10/1984 | Mahal | |
| 4,484,351 | A | 11/1984 | de Leeuwe et al. | |
| 4,547,900 | A * | 10/1985 | Larkin et al. | 383/5 |
| 4,559,052 | A * | 12/1985 | Babson | 604/403 |
| 4,592,092 | A * | 5/1986 | McPhee | 383/80 |
| 4,732,299 | A | 3/1988 | Hoyt | |
| 4,836,397 | A * | 6/1989 | Fowles | 220/214 |
| 5,088,994 | A | 2/1992 | Porat et al. | |
| 5,125,919 | A * | 6/1992 | Miller et al. | 604/408 |
| 5,125,921 | A * | 6/1992 | Duschek | 604/415 |
| 5,188,328 | A | 2/1993 | Rani et al. | |
| 5,290,105 | A | 3/1994 | Tencati | |
| 5,330,464 | A | 7/1994 | Mathias et al. | |
| 5,514,123 | A | 5/1996 | Adolf et al. | |
| 5,540,674 | A * | 7/1996 | Karas et al. | 604/415 |

(Continued)

FOREIGN PATENT DOCUMENTS

| | | |
|---|---|---|
| EP | 0 830 874 | 9/1997 |

(Continued)

*Primary Examiner*—Frederick C. Nicolas
(74) *Attorney, Agent, or Firm*—Gary M. Lobel

(57) ABSTRACT

The present invention relates to a sterile closure device that is particularly suited for flexible containers, or pouches, that contain medical fluids. The sterile closure device provides a port for a conventional spike set to puncture in order to attach a patient feeding line. The sterile closure device features at least two protection mechanisms that enhance sterility. Between the two protection mechanisms is a sterile chamber that minimizes leakage of medical fluid from the flexible container when the protection mechanisms are breached by a the spike set. The sterile closure device also features finger support to facilitate the user in grasping and puncturing the sterile closure device.

17 Claims, 6 Drawing Sheets

U.S. PATENT DOCUMENTS

| | | | | |
|---|---|---|---|---|
| 5,582,884 | A | 12/1996 | Ball et al. | |
| 5,743,443 | A | 4/1998 | Hins | |
| 5,755,712 | A | 5/1998 | Szempruch et al. | |
| 5,823,383 | A | 10/1998 | Hins | |
| 6,050,451 | A | 4/2000 | Hess, III et al. | |
| 6,131,806 | A | 10/2000 | Hess, III et al. | |
| 6,138,849 | A | 10/2000 | Roemer et al. | |
| 6,179,821 | B1 * | 1/2001 | Caspary et al. | 604/403 |
| 6,273,307 | B1 | 8/2001 | Gross et al. | |
| 6,439,429 | B1 * | 8/2002 | Gross | 222/92 |
| 6,485,479 | B1 | 11/2002 | Knierbein | |
| 2003/0075469 | A1 | 4/2003 | Herbert | |

FOREIGN PATENT DOCUMENTS

| | | |
|---|---|---|
| WO | WO 98/45188 | 10/1998 |
| WO | WO 98/45189 | 10/1998 |
| WO | WO 00/02517 | 1/2000 |

* cited by examiner

CLOSURE DEVICE FOR FLEXIBLE POUCHES

This application claims the benefit of U.S. Provisional Application No. 60/417,917, filed Oct. 11, 2002.

FIELD OF THE INVENTION

The present invention relates to closure devices, and more particularly, sterile closure devices that are suitable for pouches containing medical fluids that can be intravenously or enterally administered to a patient. The closure devices of the present invention maintain sterility of the pouch when used with conventional spike sets.

BACKGROUND OF THE INVENTION

Many individuals in hospitals or nursing homes cannot orally take nourishment or medication. These individuals, or medical patients, typically receive medical fluids containing the requisite nourishment and/or medication intravenously or enterally via a patient feeding line that is connected to a container holding such medical fluids. These medical fluids are commonly packaged in flexible containers, for example flexible pouches. Such a pouch is typically constructed from two webs of plastic film that have a series of edge seals so as to form a bag defining a reservoir to contain the medical fluid. A closure device is placed between the webs during the sealing process to create a communication between the reservoir and the patient feeding line.

The medical fluids that are typically administered to a patient need to be sterile. Thus, the seal created by the closure device between the flexible pouch and the patient feeding line should be airtight. The closure device serves to prevent contaminants from entering the patient feeding line and harming the patient. Moreover, for oxygen sensitive medical fluids, the closure device prevents oxygen from entering the opening of the flexible pouch.

Prior art closure devices typically have a single barrier that prevents the contents of the container from being exposed to the environment. In the event that this barrier ruptures, for example during a retorting process, the medical fluid would leak from the container and be exposed to non-sterile conditions and oxygen. Prior methods of maintaining sterility have also included swabbing or wiping the outside surface of the closure device with alcohol prior to spiking.

Furthermore, the barrier of closure devices are typically located near the opening of the package itself, medical fluid commonly leaks from the container as a conventional spike set, or spike, is used to puncture the barrier. An example of a conventional spike set is COMPAT® piercing spike sets distributed by Novartis Nutrition Corporation (Minneapolis, Minn.).

Thus, there is a need for a novel closure device that presents additional protection in the event that the closure device ever ruptures by featuring multiple protection mechanisms. Furthermore, the novel closure device must be easily implemented in a flexible pouch system and be compatible with flexible spikes.

SUMMARY OF THE INVENTION

It is thus an object of the present invention to provide a closure device that is suitable for use with flexible pouches and compatible with spikes. The closure device has, for example, a lenticular shape, that allows it be inserted in between the two sides of a flexible pouch. The closure device forms the exit port for medical fluid from the flexible bag.

It is yet another object of the present invention to provide an inexpensive and easily manufactured closure device. The closure device, for example, is of a unitary construction made entirely of a single material, for example a polymer. Three parts of the closure device are identifiable as a base, a mid-section and a finger support. Extending through each part is a cylindrical member with a diameter that is sized to receive a spike or other device used to connect a patient feeding line.

Yet a further object of the present invention is to provide a closure device that features at least two protection mechanisms, or seals. For instance, the inlet of the cylindrical member is sealed by a weakened area that is penetrable by a spike. The outlet of the cylindrical member is then covered by a seal, for example, a foil seal. Disposed between the weakened area and the seal is a sterile chamber that is physically separated from the flexible container by the weakened area. The sterile chamber serves to provide additional protections against contamination during the spiking process or the sterilization process, for example retorting.

Another object of the present invention is to provide a closure device that can be easily handled and gripped by a user. The closure device has a finger support which, for example, takes the shape of wings. The user can grip the edges of the wings with one hand with a spike in the other hand.

Numerous, other objects, features and advantages of the present invention will readily become apparent from the following detailed description, from the claims and from the accompanying drawings.

BRIEF DESCRIPTION OF THE DRAWINGS

The accompanying drawings, which are incorporated in and constitute a part of the specification, illustrate an exemplary embodiment of the present invention.

DETAILED DESCRIPTION OF THE INVENTION

Figure 1:
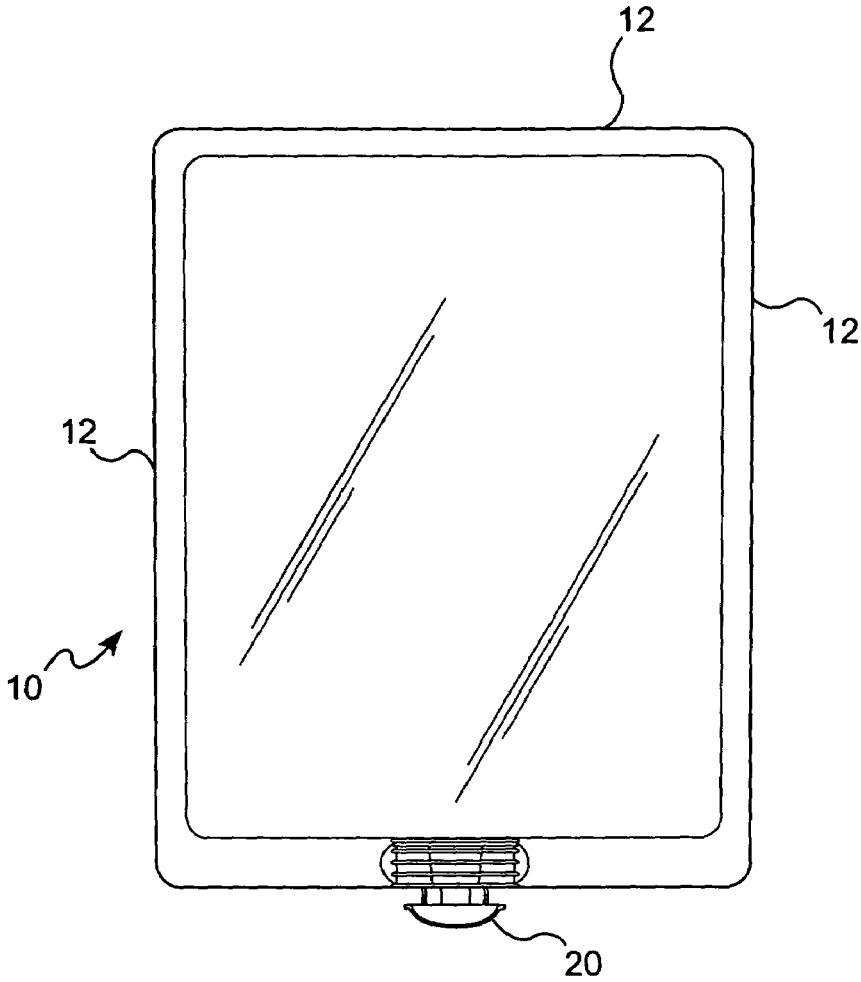
FIG. 1 is a front view of a flexible pouch in connection with a closure device in accordance with an embodiment of the present invention.
Figure 2:
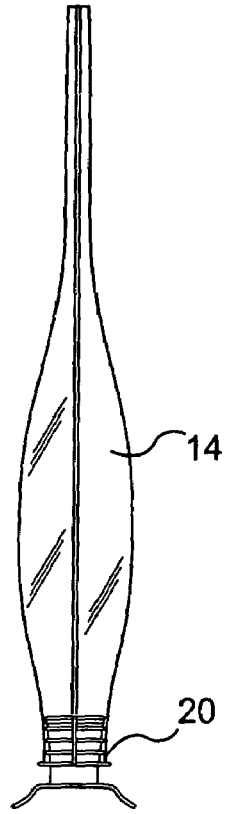
FIG. 2 is a side elevational view of the flexible pouch and the closure device in accordance with an embodiment of the present invention.
Figure 3:
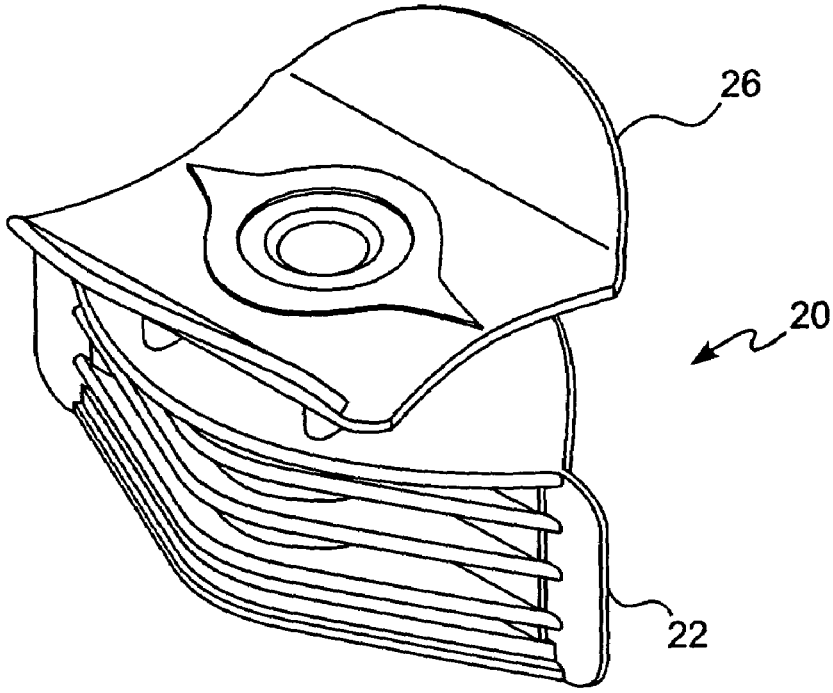
FIG. 3 is a perspective view from an upper, front, right-side vantage of the closure device without a peelable seal in accordance with an embodiment of the present invention.
Figure 4:
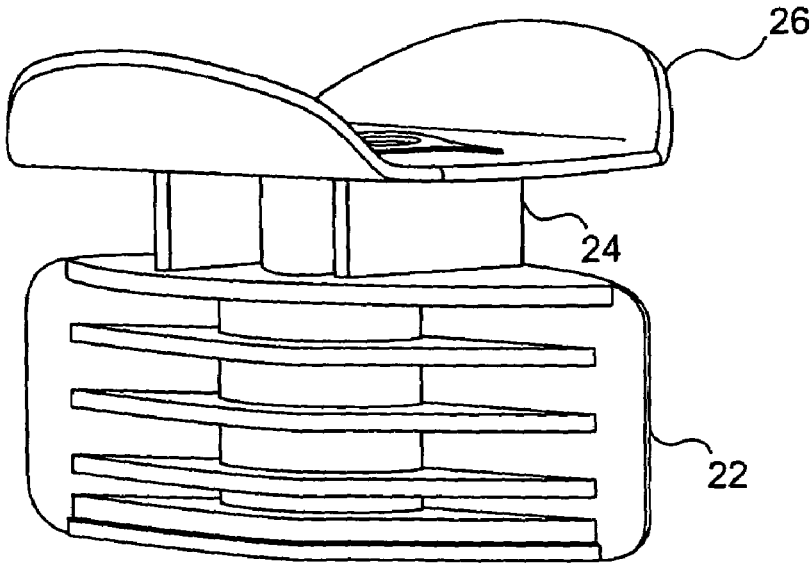
FIG. 4 is a perspective view from a front, right-side vantage of the closure device without a peelable seal in accordance with an embodiment of the present invention.
Figure 5:
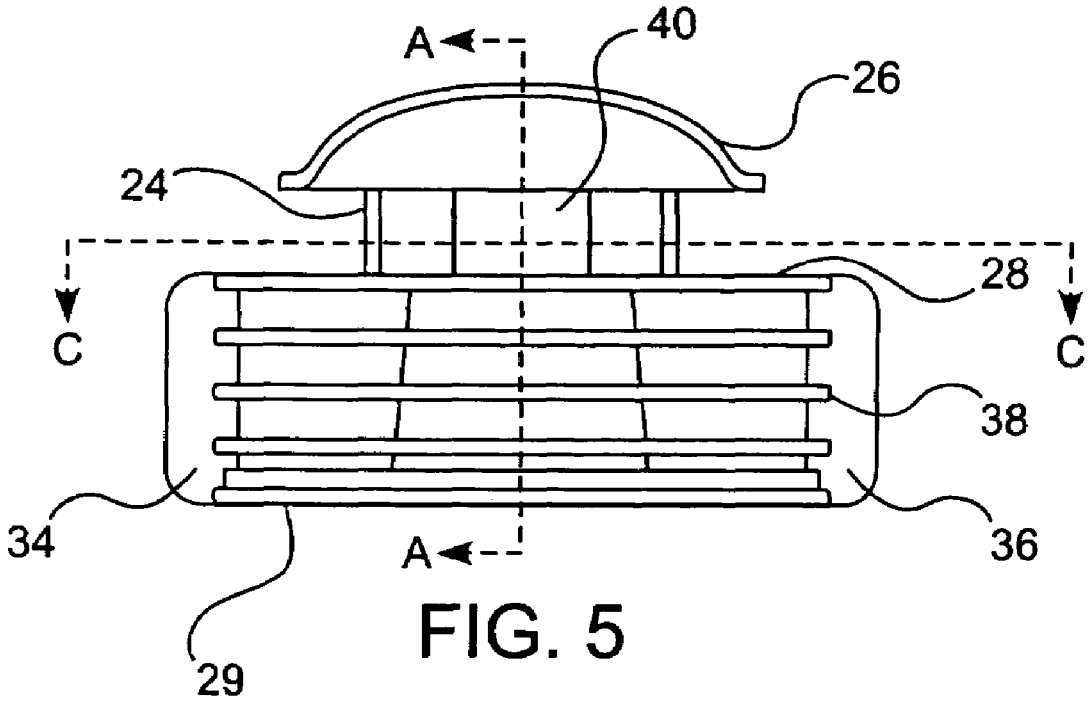
FIG. 5 is a front elevational view of the closure device depicted in FIGS. 3 and 4.

Referring to FIGS. 1 and 2, flexible pouch 10 is formed from at least a single sheet of flexible material that has no or low permeability to oxygen. The sheet may be a monolayer of the flexible material or composed of multiple layers of different flexible materials. For example, flexible materials include, but are not limited to, polyester, ethylene vinyl acetate, cast polypropylene, aluminum oxide coated nylon, aluminum, biaxially oriented nylon and multiple layers thereof . Typically, however, flexible pouch is formed from two sheets of flexible material. Edges 12 of flexible pouch 10 are sealed, for instance by heat, ultrasound or impulse, such that edges 12 define reservoir 14 within flexible pouch 10. Reservoir 14 contains a medical fluid providing nutrition to a patient.

Connected to a side of flexible pouch 10 is closure device 20 which serves as the exiting point for the medical fluid from flexible pouch 10. Closure device 20 is molded as a single unitary construction, for example, from a polymeric material that has low permeability to oxygen. The appropriate polymeric material should be capable of forming an airtight seal with the material from which flexible pouch 10 is made. Furthermore, the polymeric material should be sterilizable, for example by a retort sterilization process. Examples of polymeric materials include, but are not limited to, high density polyethylene, polypropylene, ethylene vinyl acetate, polyvinylidene chloride, nylon and combinations thereof. Preferably, closure device 20 is made from polypropylene. Closure device 20 is attached to flexible pouch 10 by methods including, but not limited to heat induction, ultrasonic welding and friction welding or any other means as known in the art. Although closure device 20 can be incorporated into any type of container, e.g., a bottle, tube or other form of packaging as known to a skilled artisan, it is preferred that the closure device 20 be used with a flexible pouch.

FIGS. 5 through 10 illustrate the details of the structure of closure device 20. Closure device 20 generally comprises base 22, mid-section 24 and finger support 26. Although base 22 can have any type of geometric shape, for instance a cylinder as in the prior art. A flexible pouch is essentially two flat sheets, and when a cylindrical shape is inserted between the two flat sheets additional stresses are generated in the flexible pouch around the closure device. These additional stresses may lead to breakage or rupture of the container. In accordance with this concern, base 22 is preferably lenticular, or boat-shaped.

Base 22 has at least a top surface 28, bottom surface 29 and two, generally opposite facing side surfaces 30, 32 that taper into partitions 34, 36. Bottom surface 29 is perpendicular the lengthwise axis of flexible pouch 10 and is the surface of base 22 that is closest to the medical fluid in flexible pouch 10. Facing side surfaces 30, 32 serve as the attachment points of closure device 20 to flexible pouch 10. To facilitate and enhance securement to flexible pouch 10, each facing side surface 30, 32 features axially spaced and integrally formed ribs 38. Any number of ribs 38 can be provided on each facing side surface 30, 32. Alternatively, ribs 38 can be entirely eliminated. Partitions 34, 36 traverse centrally through ribs 38 and help maintain the spacing of ribs 38.

Figure 8:
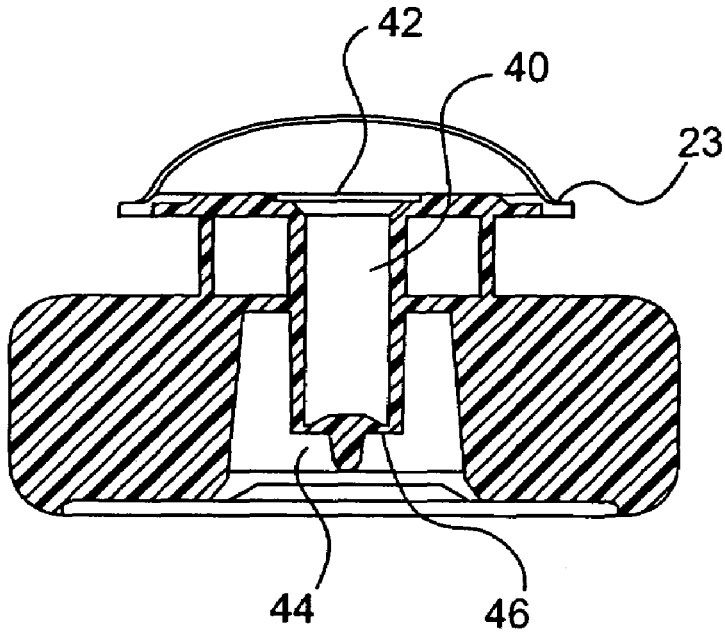
FIG. 8 is a cross-section of the closure device without a peelable seal in accordance with an embodiment of the present invention taken along line A-A of FIG. 5.

In the center of base 22 and extending therethrough is cylindrical member 40. Cylindrical member 40 outwardly extends from bottom surface 29 of base 22 through mid-section 24 and ultimately ends in finger support 26. At finger support 26, cylindrical member 40 has outlet 42. Outlet 42, for example, is recessed. At the end opposite from outlet 42 is inlet 44. Prior to use and spiking, inlet 44 is closed off and, for example, sealed to form weakened area 46. Alternatively, instead of having weakened area 46 block inlet 44, weakened area 46 can be disposed anywhere along the entire length of cylindrical member 40 provided that it blocks cylindrical member 40. Weakened area 46 serves as a protection mechanism or seal by creating a barrier between reservoir 14 of flexible pouch 10 and the exterior environment to maintain both sterility and cleanliness. Furthermore, weakened area 46 prevents any medical fluid from leaking out of flexible pouch 10. Perpendicular from weakened area 46 is extension 48 which is optional. Extension 48 serves to facilitate manufacturing of closure device 20. The diameter of cylindrical member 40 should be sized to receive a spike. For example, the diameter can range from about 0.5 mm (approximately 0.020 inches) to about 12 mm (approximately 0.47 inches). It is preferred, although not necessary, that the diameter of weakened area 46 be larger than the diameter of a spike. In order to make weakened area 46 pierceable, the outer perimeter of weakened area 46 can have a thickness less than the thickness of the center of weakened area 46 as shown in FIG. 8. Other methods to render weakened area 46 pierceable include, but are not limited to, scoring and grooving the weakened area 46.

Attached to top surface 28 is mid-section 24 which features three discrete elements which are cylindrical member 40 and two spacers 50, 52. Spacers 50, 52, for example, are rectangular in shape and parallel to each other and perpendicular to the long axis of base 22 and top surface 28. Spacers 50, 52 provide a means for separating finger support 26 from top surface 28 and a means for extending the length of cylindrical member 40 which also extends through base 22 as previously discussed. Moreover, spacers 50, 52 facilitate manufacturability of closure device 20. Spacers 50,52 also provide of method of orienting finger support 26 to base 22. Although mid-section 24 can be removed from closure device 20, it is preferably included which will be made apparent in the discussion below. Although spacers 50, 52 can be positioned anywhere within mid-section 24, spacers 50, 52 are preferably positioned one each side of cylindrical member 40. Additionally, in alternative embodiments, the spacers 50, 52 can be excluded from mid-section 24 in their entirety.

Figure 6:
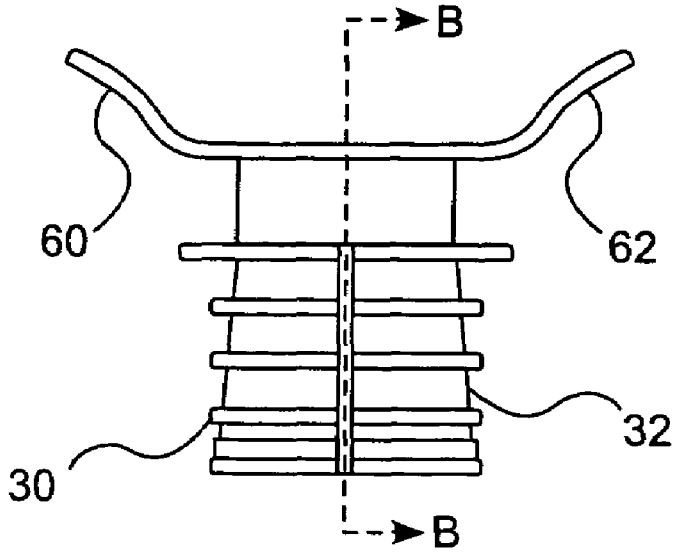
FIG. 6 is a side elevational view of the closure device depicted in FIGS. 3, 4 and 5.
Figure 7:
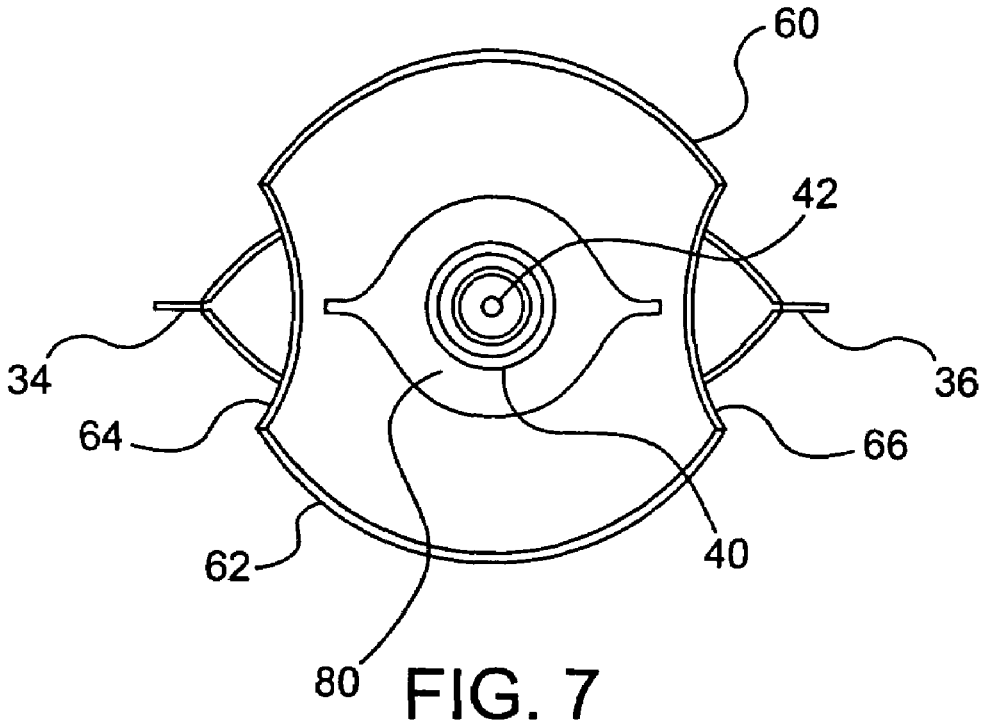
FIG. 7 is a top plan view of the closure device depicted in FIGS. 3, 4, 5 and 6.
Figure 9:
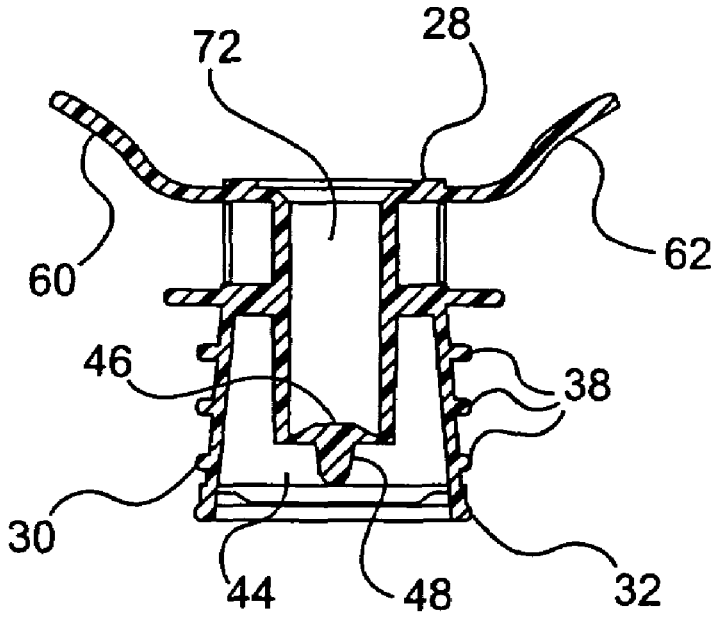
FIG. 9 is a cross-section of the closure device without a peelable seal in accordance with an embodiment of the present invention taken along line B-B of FIG. 6.
Figure 10:
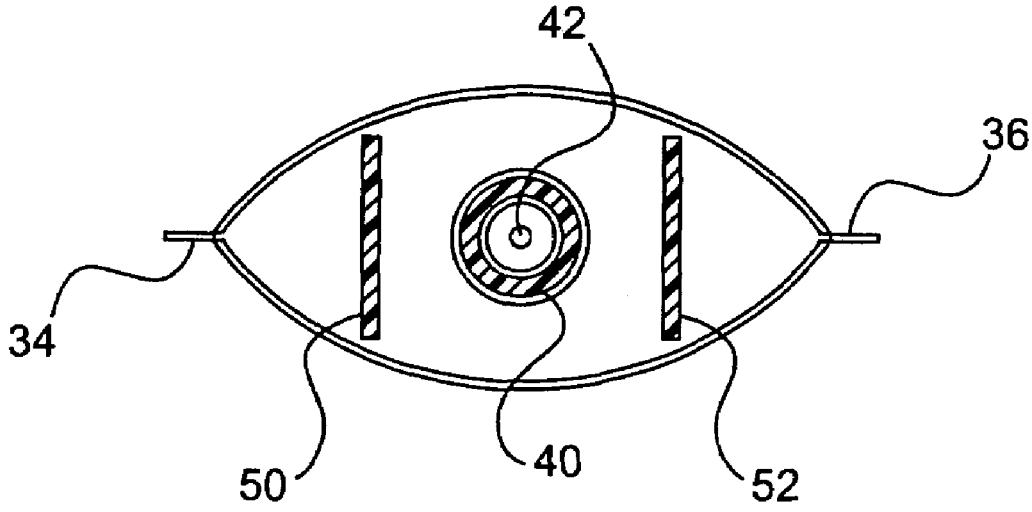
FIG. 10 is a cross-section of the closure device without a peelable seal in accordance with an embodiment of the present invention taken along line C-C of FIG. 5.

Continuous with mid-section 24 is finger support 26. Finger support 26 can be, for example, a flange around outlet 42 of cylindrical member 40. Finger support 26, for example, is predominantly planar and parallel to top surface 28 and bottom surface 29 of base 22; however, sections of the perimeter can be flipped or directed outwardly from base 22 to form wings 60, 62. As illustrated in FIGS. 6 and 9, wings 60, 62 are semi-circular in shape, although any other shape is suitable. Wings 60, 62 provide a means for the user to grip closure device 20 in order to keep closure device 20 steady when a spike is being used to puncture weakened area 46 of base 22. Additionally, wings 60, 62 help prevent the fingers of the user from touching cylindrical member 40 and outlet 42, thus, ensuring sterility and cleanliness. Along the two perimeter sections between wings 60, 62, are two arcs 64, 66. These arcs 64, 66 are optionally provided and reduce the material of finger support 26. Attached to, or formed as a part of the outer surface of, finger support 26 is seal 70.

Figure 11:
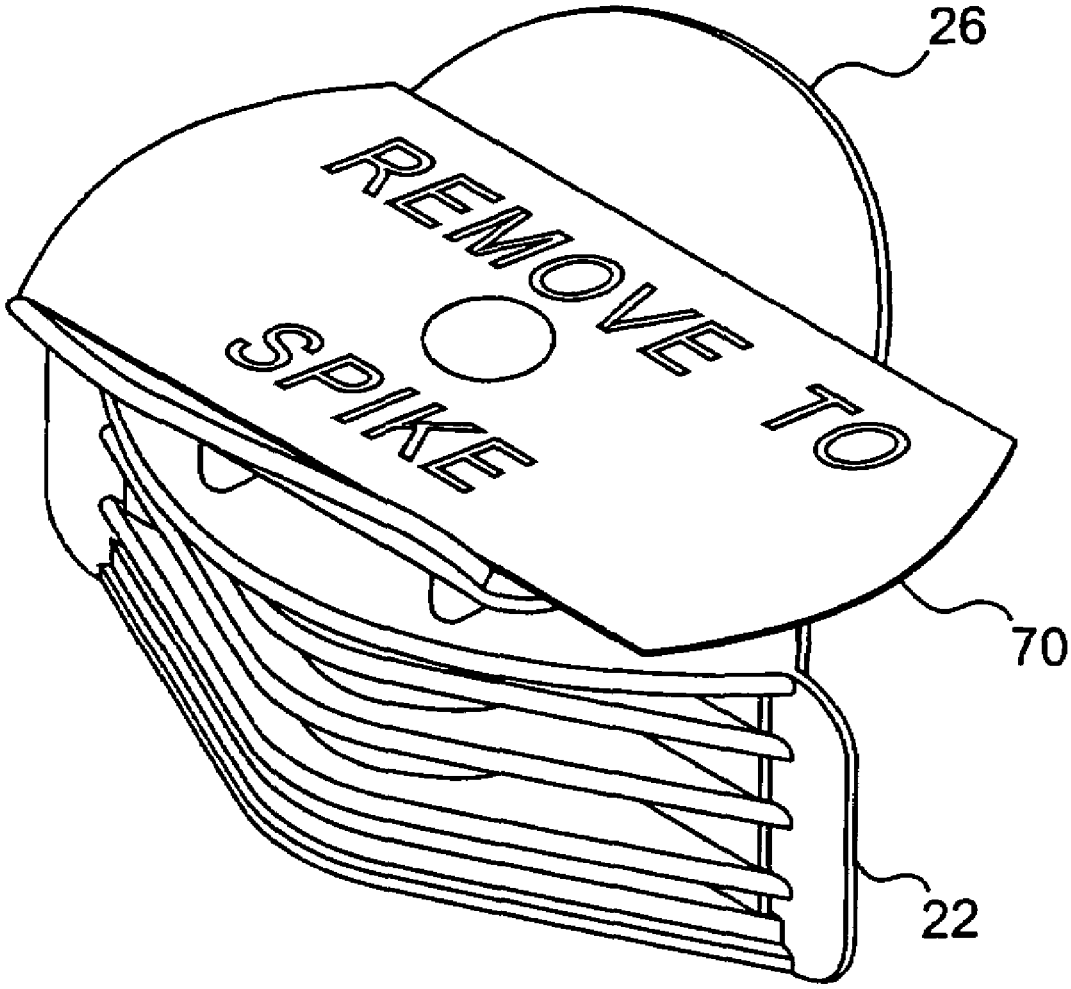
FIG. 11 is a perspective view from an upper, front, right-side vantage of the closure device with a peelable seal in accordance with an embodiment of the present invention.

Referring to FIG. 11, for example, seal 70 hermetically covers outlet 42 and has no or low permeability to oxygen. Seal 70 should be defeatable in some manner, for example by removal or by penetration. Examples of materials suitable for use as seal 70 include, but are not limited, to a peelable foil seal, a penetrable foil seal, a penetrable polymeric membrane, a screw-on cap, a twist-off cap and a snap-on cap. Preferably, seal 70 is a foil laminate seal that is adhesively sealed to finger support 26. The foil laminate for seal 70 can be a single or multi-laminate material suitable to provide a peelable seal with the surface of finger support 26. The foil, for example, is heat-sealed to finger support 26, by flowing a heated food grade hot melt adhesive between the seal 70 and finger support 26. Alternatively and more preferably, the foil seal is thermally self-sealed when the outer layer of the foil is compatible with the polymeric material of closure device 20. Seal 70 provides an additional protection mechanism that isolates the medical fluid contamination. In the event weakened area 46 ever is broken unintentionally, for example during sterilization, the medical fluid is still protected by seal 70. Thus, there are two layers of protection built into closure device 20 of the present invention: weakened area 46 and seal 70. Within cylindrical member 40 between weakened area 46 and seal 70 is chamber 72 which remains sterile and physically separated from flexible pouch 10 until seal 70 is breached provided that the entire closure device 20 and pouch 10 have been sterilized.

Optionally included is raised surface 80 that surrounds outlet 42. Raised surface 80, for example, is formed from the polymeric material that makes up finger support 26. Raised surface 80, for example, tapers into points on each side of outlet 42. The incorporation of raised surface 80 when using seal 70 that is a foil laminate makes it easier to peel seal 70 away from the surface of finger support 26. Raised surface 80, for example, creates a starting point, such that when a user begins to remove the seal 70, all of the force expended by the user is concentrated at a localized point, i.e., the end of the taper.

To administer the medical fluid to a patient using closure device 20 of the present invention, the user first grips closure device 20 by grasping wings 60, 62 of finger support 26. Next, the user breaches seal 70, for instance by peeling, to expose outlet 42 of cylindrical member 40. The sharp end of a spike is then plunged through chamber 72 of cylindrical member 40 penetrating weakened area 46, thus releasing the medical fluid into the patient feeding line.

In the prior art closure devices, the outlet for the medical fluid to flow is coplanar with the bottom of the container holding the medical fluid. When the closure device is spiked, as soon as the tip of the spike punctures the closure device, the medical fluid immediately flows and leaks from the container. An additional feature of closure device 20 of the present invention is that it minimizes any leaks during the spiking process. As a spike is plunged into cylindrical member 40, it first enters outlet 42 and immediately contacts chamber 72. Because the diameter of chamber 72 is slightly smaller than that of the spike set, the spike set is in physical contact with the inner wall of chamber 72 as soon as the spike enters chamber 72. Thus, a physical barrier is formed to prevent leakage, as the spike moves through chamber 72. When the tip of the spike finally breaches weakened area 46, any fluid that escapes from flexible pouch 10 enters the spike, not the area between the spike and the inner wall of chamber 72.

In an alternative embodiment, the mid-section can be entirely eliminated; thus the top surface of the base would be flush against the outer surface of the finger support. The length of the cylindrical member is shortened and the portion of the cylindrical member within the base becomes the entire chamber. In yet another alternative embodiment, the wings of finger support can be directly attached to the surface of the base and thus form extensions of the top surface or bottom surface of the base.

In yet another alternative embodiment, closure device includes a base with a mid-section without any spacer. Thus, the cylindrical member extends through and projects outwardly from base. In this embodiment there is no finger support. Both the inlets and outlets of the cylindrical member are sealed by protection mechanisms as discussed above with one protection mechanism, for example a weakened area, being disposed anywhere along the length of the cylindrical member and an additional protection sealing the outlet of the cylindrical member.

It is understood that while the present invention has been described in conjunction with the detailed description thereof that the foregoing description is intended to illustrate and not limit the scope of the invention, which is defined by the scope of the following claims. Other aspects, advantages and modifications are within the scope of the claims.

What is claimed:

1. A closure device for a flexible container containing a medical fluid comprising:

a boat-shaped base section having a top wall, a bottom wall, said base section adapted to fit said flexible container;

a mid-section connected to said top wall, a support connected to said mid-section and adapted for a user to grip said closure device wherein said mid-section includes at least one spacer disposed between said top wall of said base section and said support;

a cylindrical member extending through said base section, said mid-section and said support, said cylindrical member having a first opening in said base section and a second opening in said support, said cylindrical member adapted to allow said medical fluid to flow therethough and exit said flexible container;

a first seal blocking said cylindrical member and capable of being breached; and a second seal covering said second opening and capable of being defeated;

wherein a portion of said cylindrical member between said first seal and said second seal defines a chamber.

2. The closure device of claim 1, wherein said first seal covers said first opening.

3. The closure device of claim 2, wherein said first seal comprises a weakened section.

4. The closure device of claim 1, wherein said second seal is a peelable foil.

5. The closure device of claim 1, wherein said cylindrical member has a diameter from about 0.5 mm to about 12 mm.

6. The closure device of claim 5, wherein said cylindrical member is adapted to receive a spike set.

7. The closure device of claim 1, wherein said support has at least one wing.

8. The closure device of claim 1, wherein said chamber is sterile after said closure device has experienced a sterilization process.

9. The closure device of claim 1, wherein said at least one spacer comprises first and second wall members orthogonally disposed between said top wall of said base section and said support.

10. A container for a medical fluid comprising:

a pouch having a port and at least a single edge such that said edge defines a reservoir within said pouch that is adapted to contain a medical fluid; and a closure device adapted to fit said port and comprises a base section having a top wall and a bottom wall, said base section sealingly attached to said edge of said pouch at said port;

a mid-section connected to said top wall;

a support connected to said mid-section and adapted for a user to grip said closure device, wherein said support further comprises a raised surface;

a cylindrical member extending through said base section, said mid-section and said support, said cylindrical member having a first opening in said base section and a second opening in said support, said cylindrical member adapted to allow said medical fluid to flow therethough and exit said port;

a first seal blocking said cylindrical member and capable of being breached; and a second seal covering said second opening and capable of being defeated, wherein said second seal is a peelable foil;

wherein a portion of said cylindrical member between said first seal and said second seal defines a chamber.

11. The container of claim 10, wherein said first seal covers said first opening of said cylindrical member.

12. The container of claim 11, wherein said first seal is a weakened area.

13. The container of claim 10, wherein said closure device is made of a polymer material.

14. The container of claim 10, wherein said chamber is sterile after said closure device is sterilized.

15. The container of claim 10, wherein said cylindrical member has a diameter from about 0.5 mm to about 12 mm.

16. The container of claim 10, wherein said support has at least one wing.

17. A closure device for a flexible container containing a medical fluid comprising:

a boat-shaped base section having a top wall and a bottom wall, said base section adapted to fit said flexible container and having a first width;

a mid-section connected to said top wall, said mid-section having a second width that is smaller than said first width, a support connected to said mid-section, said support comprising at least one wing angulated with respect to said top wall and adapted for a user to grip said closure device wherein said mid-section includes at least one spacer disposed between said top wall of said base sectyion and said support;

a cylindrical member extending through said base section, said mid-section and said support, said cylindrical member having a first opening in said base section and a second opening in said support, said cylindrical member adapted to allow said medical fluid to flow therethough and exit said flexible container;

a first seal blocking said cylindrical member and capable of being breached; and a second seal covering said second opening and capable of being defeated;

wherein a portion of said cylindrical member between said first seal and said second seal defines a chamber.

* * * * *